US006564187B1

(12) United States Patent
Kikumoto et al.

(10) Patent No.: US 6,564,187 B1
(45) Date of Patent: May 13, 2003

(54) WAVEFORM SIGNAL COMPRESSION AND EXPANSION ALONG TIME AXIS HAVING DIFFERENT SAMPLING RATES FOR DIFFERENT MAIN-FREQUENCY BANDS

(75) Inventors: Tadao Kikumoto, Shizuoka (JP); Atsushi Hoshiai, Hannan (JP); Satoshi Kusakabe, Hamamatsu (JP)

(73) Assignee: Roland Corporation, Osaka (JP)

( * ) Notice: Subject to any disclaimer, the term of this patent is extended or adjusted under 35 U.S.C. 154(b) by 0 days.

(21) Appl. No.: 09/536,386

(22) Filed: Mar. 28, 2000

(51) Int. Cl.[7] ..... G10L 21/04
(52) U.S. Cl. ..... 704/503; 704/205; 704/500
(58) Field of Search ..... 704/205, 500, 704/503

(56) References Cited

U.S. PATENT DOCUMENTS

| | | | | |
|---|---|---|---|---|
| 3,946,504 | A | 3/1976 | Nakano | 35/35 |
| 4,805,217 | A | 2/1989 | Morihiro et al. | 381/35 |
| 4,876,937 | A | 10/1989 | Suzuki | 84/612 |
| 5,315,057 | A | 5/1994 | Land et al. | 84/601 |
| 5,347,478 | A | 9/1994 | Suzuki et al. | 364/715.02 |
| 5,350,882 | A | 9/1994 | Koguchi et al. | |
| 5,412,152 | A | 5/1995 | Kageyama | 84/607 |
| 5,471,009 | A | 11/1995 | Oba et al. | 84/645 |
| 5,499,316 | A | 3/1996 | Sudoh et al. | 395/2.79 |
| 5,511,000 | A | 4/1996 | Kaloi et al. | 364/514 |
| 5,511,053 | A | 4/1996 | Jae-Chang | |
| 5,611,018 | A | 3/1997 | Tanaka et al. | 395/2.24 |
| 5,675,709 | A | 10/1997 | Chiba | 395/2.87 |
| 5,713,021 | A | 1/1998 | Kondo et al. | 395/614 |
| 5,717,818 | A | 2/1998 | Nejime et al. | 395/2.2 |
| 5,734,119 | A | 3/1998 | France et al. | 84/622 |
| 5,745,650 | A | 4/1998 | Otsuka et al. | |
| 5,763,800 | A | 6/1998 | Rossum et al. | 84/603 |
| 5,765,129 | A | 6/1998 | Hyman et al. | 704/270 |
| 5,774,863 | A | 6/1998 | Okano et al. | 704/278 |
| 5,781,696 | A | 7/1998 | Oh et al. | 395/2.79 |
| 5,792,971 | A | 8/1998 | Timis et al. | 84/609 |
| 5,809,454 | A | 9/1998 | Okada et al. | 704/214 |
| 5,847,303 | A | 12/1998 | Matsumoto | 84/610 |
| 5,873,059 | A | 2/1999 | Iijima et al. | 704/207 |
| 5,886,278 | A | 3/1999 | Yoshida | 84/604 |
| 5,952,596 | A | 9/1999 | Kondo | |
| 5,973,255 | A | 10/1999 | Tanji | |
| 6,169,240 | B1 | 1/2001 | Suzuki | 84/605 |

OTHER PUBLICATIONS

Karlheinz Brandenburg and Gerhard Stoll, "ISO–MPEG–1 Audio: A Generic Standard for Coding of High–Quality Digital Audio" in Collected Papers on Digital Audio Bit–Rate Reduction, ed. by Neil Gilchrister and Christ Grewin, p. 31–42, Audio Engineering Society, Jun. 1996.*

Keith Lent, *An Efficient Method for Pitch Shifting Digitally Sampled Sounds*, Computer Music Journal, vol. 13, No. 4, Winter 1989, pp 65–71.

* cited by examiner

*Primary Examiner*—Tālivaldis Ivars Šmits
(74) *Attorney, Agent, or Firm*—Foley & Lardner

(57) ABSTRACT

An apparatus and method for compression and expansion of a wave signal on a time axis. A memory device stores waveform data representative of a waveform for each sub-frequency band of each main-frequency band of a wave signal, in which the wave signal is divided into a plurality of the main-frequency bands, each of the main-frequency bands is divided into a plurality of the sub-frequency bands. A plurality of time axis compression and expansion devices are provided for each of the sub-frequency bands for performing time axis compression and expansion of the waveform. A mixing device mixes signals provided from the time axis compression and expansion devices. Each of the time axis compression and expansion devices performs compression and expansion in a sampling rate that corresponds to one of the main-frequency bands that includes the sub-frequency band that is subject to the waveform time axis compression and expansion, wherein the sampling rate of at least one of the main-frequency bands is different from the sampling rate of at least one other of the main frequency bands.

25 Claims, 11 Drawing Sheets

WAVEFORM SIGNAL AT THE TIME OF RECORDING ON A TAPE.
(BEFORE THE WAVEFORM SIGNAL IS EXPANDED.)

WAVEFORM SIGNAL AT THE TIME OF REPRODUCTION
WITH A REDUCED ROTATION SPEED OF THE TAPE
SLOWER THAN THE ROTATION SPEED AT THE TIME OF RECORDING.
(AFTER THE WAVEFORM SIGNAL IS EXPANDED.)

MULTIPLE-RATE PRE-PROCESS UNIT

MULTIPLE-RATE PRE-PROCESS UNIT

COMPLEX ONVERSION OF BAND SIGNAL

WAVEFORM SIGNAL COMPRESSION AND EXPANSION ALONG TIME AXIS HAVING DIFFERENT SAMPLING RATES FOR DIFFERENT MAIN-FREQUENCY BANDS

BACKGROUND OF THE INVENTION

1. Field of the Invention

The present invention relates to an apparatus and method for compression and expansion of a wave signal on a time axis. More particularly, the present invention relates to an apparatus and method for compression and expansion of a wave signal on a time axis in which the compression and expansion of the waveform signal on a time axis can be performed smoothly.

2. Description of Related Art

In general, for example, the time axis compression and expansion technology (hereafter, referred to as "time stretch technology" as the circumstances warrant) has come to be utilized in the music production field as a technology for the reproduction of a waveform signal. In accordance with the time stretch technology, reproduction time of the waveform signal that has been recorded is compressed and expanded on the time axis.

For example, the rotation speed of the tape on the tape recorder at the time of recording on the tape may be made different from the rotation speed of the tape at the time of playing back the tape. This allows compression or expansion of the reproduction time of the audio signal that has been recorded on the tape on the time axis.

Let us assume that a waveform signal shown in FIG. 1 is recorded on the tape. When the rotation speed of the tape is reduced at the time of reproducing the waveform signal to a lower rotation speed than the rotation speed of the tape at the time of recording to thereby expand the reproduction time, the waveform signal shown in FIG. 1 is reproduced and changed to a waveform signal shown in FIG. 2, in which the waveform is merely proportionately expanded. As a result, the more the reproducing time is expanded, the more the frequency changes (the frequency lowers).

Therefore, in the conventional time stretch technology, waveform signals are successively, temporarily stored in a digital memory or the like, specified signal segments are culled or specified segments are repeated such that the reproduction time is compressed or expanded on the time axis.

Hereafter, the compression of the reproduction time on the time axis and the expansion of the reproduction time on the time axis will be simply referred to as "compression" and "expansion", respectively, as the circumstance warrants.

However, when a continuous waveform is subject to the culling or repetition, connection points between segment waveform signals at the time of culling and repetition become discontinuous. This results in another problem in that noises are generated.

In view of the above, a technique has been proposed to suppress the generation of noises and maintain the continuity of the plural waveforms by means of the cross-fading of the connection points of the waveform signals described above. The "cross-fading" is a technique for continuously reproducing a plurality of waveforms, in which an end section of one of the waveforms (a "first waveform") and a beginning section of another of the waveforms (a "second waveform") that immediately succeeds the first waveform are overlapped one on another. In addition, the loudness of the overlapping section of the first waveform is gradually decreased and, at the same time, the loudness of the overlapping section of the second waveform is gradually increased. However, this technique cannot completely prevent the fluctuation of the waveform signals or the generation of rippling, and therefore cannot provide a fundamental solution to the problems.

Furthermore, a waveform signal that is formed from a mixture of a plurality of different musical sounds has a relatively weak periodicity. Accordingly, the above-described technique suffers an additional difficulty in smoothly connecting the segment waveform signals at each connection section where the culling or the repetition of the waveform signal is performed.

Incidentally, it is known that a waveform signal having a mixture of plural musical sounds frequently has different waveform signal characteristics for different frequency bands.

In order to solve the problem of the discontinuity at each connection section of adjacent waveform signal segments when the culling or the repetition of the waveform signal is performed, one technique has been proposed. In this technique, a waveform signal that is subject to compression or expansion on the time axis is divided into main-frequency bands. The waveform signal of each of the divided frequency bands is independently compressed or expanded, such that the waveform signal is, as a whole, smoothly compressed or expanded on the time axis.

In this technique, a complex waveform signal that includes many overtones may be divided into as many frequency-bands as possible to provide smoother compression and expansion of the waveform signal on the time axis. However, when the number of bands (frequency bands) is increased, the amount of processing required for processing the waveform signal becomes substantial, and this makes it difficult to construct a low-cost system.

SUMMARY OF THE DISCLOSURE

The present invention has been made in view of the problems of the conventional techniques described above. It is an object of the present invention to provide an apparatus and method for compression and expansion of a wave signal on a time axis that makes it possible to structure a low-cost system. This is achieved by dividing a waveform signal that is subject to compression and expansion on a time axis into main-frequency bands, and independently compressing and expanding the waveform signals of the divided frequency bands. As a result, the present invention suppresses an increase in the amount of signal processing of the waveform signals, that results from an increase in the number of bands (frequency bands), which may be required when a generally smoother compression and expansion process on the time axis is desired.

To achieve the object described above, an apparatus and method for compression and expansion of a wave signal on a time axis, in accordance with the present invention, uses a multi-rate sampling technique to thereby avoid an increase in the amount of processing required for processing waveform signals.

In view of the above, the present invention provides high-speed and high sound quality compression and expansion of a waveform signal on a time axis, using a multiple-rate signal processing technique that takes into account the auditory sense.

In accordance with one embodiment of the present invention, an apparatus for compression and expansion of a wave signal on a time axis comprises: a memory device that stores waveform data representative of a waveform for each sub-frequency band of each main-frequency band of a wave signal, in which the wave signal is divided into a plurality of the main-frequency bands, each of the main-frequency bands is divided into a plurality of the sub-frequency bands; a plurality of time axis compression and expansion devices, each provided for each of the sub-frequency bands for performing, based on the waveform data for each of the sub-frequency bands, time axis compression and expansion of the waveform that is represented by the waveform data; and a mixing device that mixes signals provided from the plurality of time axis compression and expansion devices. Each of the plurality of time axis compression and expansion devices performs compression and expansion in a process frequency that corresponds to one of the main-frequency bands to which the sub-frequency band subjected to the waveform time axis compression and expansion belongs, and wherein a process frequency of at least one of the main-frequency bands is different from a process frequency of at least one other of the main-frequency bands.

In accordance with one embodiment of the present invention, each of the main-frequency bands have the same number of sub-frequency bands.

In accordance with one embodiment of the present invention, the time axis compression and expansion devices for the waveform signal are implemented by software, and a program sub-routine for a time axis compression and expansion process in one main-frequency band is commonly used for a time axis compression and expansion process in another main-frequency band.

In accordance with one embodiment of the present invention, the time axis compression and expansion devices for the waveform signal are implemented by software, and the time axis compression and expansion devices for the sub-frequency bands that belong to the same main-frequency band use the same process program routine.

In accordance with one embodiment of the present invention, an apparatus for compression and expansion of a wave signal on a time axis comprises: a memory device that stores waveform data representative of a waveform for each sub-frequency band of each main-frequency band of a wave signal, in which the wave signal is divided into a plurality of the main-frequency bands, a waveform signal of each of the main-frequency bands is divided into a plurality of the sub-frequency bands; a plurality of time axis compression and expansion devices, each provided for each of the sub-frequency bands for performing, based on the waveform data for each of the sub-frequency bands, time axis compression and expansion of the waveform that is represented by the waveform data; and a mixing device that mixes signals provided from the plurality of time axis compression and expansion devices. The time axis compression and expansion devices for the sub-frequency bands that belong to the same main-frequency band perform compression and expansion in the same process frequency, and the time axis compression and expansion devices for the sub-frequency bands that belong to one of the main-frequency bands perform compression and expansion in a process frequency that is different from a process frequency for the sub-frequency bands that belong to another of the main-frequency bands.

The "process frequency" of the present invention may be a sampling rate, for example.

These and other features, and advantages of embodiments of the invention will be apparent to those skilled in the art from the following detailed description of embodiments of the invention, when read with the drawings and appended claims.

DETAILED DESCRIPTION OF EMBODIMENTS OF THE INVENTION

Figure 1:
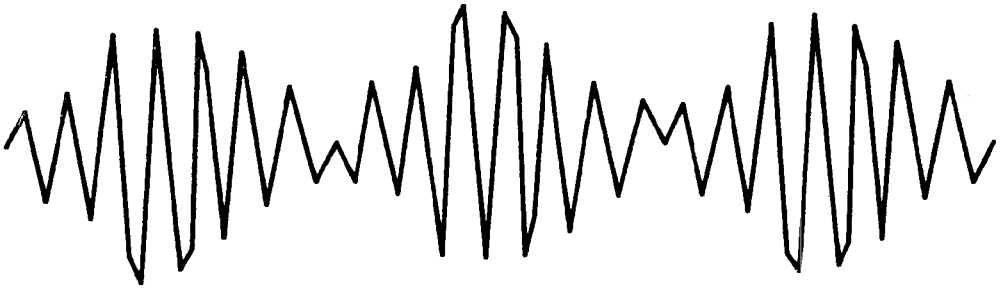
FIG. 1 shows a waveform signal at the time of recording on a tape (before the waveform signal is expanded) that is used to describe the waveform.
Figure 2:
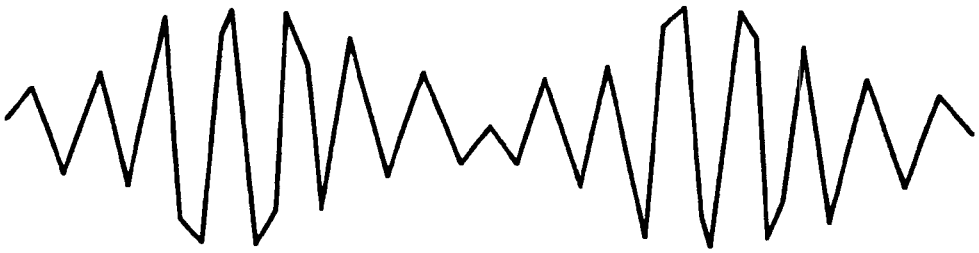
FIG. 2 shows a waveform signal at the time of reproduction with the rotation speed of the tape being slower that the rotation speed at the time of recording (after the waveform signal is expanded) that is used to describe the waveform.

Hereafter, the principle of an apparatus and method for compression and expansion of a wave signal on a time axis in accordance with the present invention will be described. The apparatus and method for compression and expansion of a wave signal on a time axis of the present invention uses the characteristic of the person's auditory sense that tends to react more to a logarithmic change than a linear change not only in the loudness but also on the frequency axis.

The multiple-rate sampling technique is a technique in which a frequency band of a waveform signal is divided into halves, and each one of the divided halves is further divided into smaller halves successively and, the sampling rate for each successively divided frequency band is accordingly reduced by half. As a result, the sampling rate lowers for a lower frequency band and, therefore, an overall-processing amount for processing the waveform-signal is reduced.

In the conventional multiple-rate sampling technique, each band has a frequency bandwidth of an octave.

However, the frequency bandwidth of an octave is often too broad for a waveform signal depending on the characteristic of the waveform signal. In this respect, in an apparatus and method for compression and expansion of a wave signal on a time axis in accordance with the present invention, a frequency band of a waveform signal is divided into a plurality of main-frequency bands (hereafter, referred to as "main bands" as the circumstance warrants). Further, each of the main-frequency bands is divided into a plurality of sub-frequency bands (hereafter, referred to as "sub-bands" as the circumstance warrants).

In one embodiment, each of the main-frequency bands may be linearly, i.e., equally divided into a plurality of sub-frequency bands. In this case, the plurality of sub-frequency bands in one of the main-frequency bands are sampled with the same sampling rate (the sampling rate is also referred to herein as the "process frequency"), and have the same frequency bandwidth. As a result, if the process for each of the sub-frequency bands is implemented by software, a common processing program routine can be used.

Since the spectra of one waveform signal may not be evenly distributed, the number of sub-frequency bands resulting from a division of a main-frequency band may be determined for each individual waveform signal.

When a waveform signal does not have low frequency components, the process for lower bands may be omitted, and the process for higher bands alone may be performed. Conversely, when a waveform signal does not have high frequency components, the process for higher bands may be omitted, and the process for lower bands alone may be performed. As a result, the amount of processing required for processing waveform signals can be substantially reduced.

When a waveform signal has a high fundamental frequency, the waveform signal may be divided into a low number of main bands. Taking this into account, the sampling rate may not be reduced by half, and the main band is defined as the lowermost band. Also, each main band may be divided into a lower number of sub-bands. For example, when a waveform signal contains frequency components ranging from a fundamental frequency of 2 KHz to a frequency of 14 KHz, and the waveform signal is processed with a sampling rate of 32 KHz, the waveform signal may be divided into three bands that are sampled at 32 KHz, 16 KHz and 8 KHz, respectively. The number of sub-bands in each of the main bands may be set at 8, 4 and 2, respectively. As a result, all the overtone components in the waveform signal can be separated.

Incidentally, since a natural sound has a greater fluctuation in a higher frequency range, the number of its sub-bands can be reduced for a higher main band. Therefore, each of the main bands may be divided into the same number of sub-bands for each sampling rate stage. As a result, a signal-processing program for one main band can use a routine that is used for another at the same sampling rate stage. This substantially reduces the size of the program.

It is noted that such an arrangement makes the frequency bandwidth of a higher main band wider, compared to that of a lower main band. However, based on the results obtained by experiments, it is observed that high frequency components of most of the natural sounds present relatively low signal levels and include many non-periodic components. As a result, the sound quality changes very little even when the frequency bandwidth of a higher main band is wider in comparison with that of a lower main band.

In contrast, a lower main band of a natural sound contains major components of the natural sound. The frequency bandwidth of the lower main band is sufficiently narrow, and therefore the compression and expansion on the time axis can be smoothly conducted.

As described above, the division of frequency bands is conducted such that the frequency bands have different bandwidths depending on the frequencies. For example, the frequency bandwidth is made wider for a higher main band, and the frequency bandwidth is made narrower for a lower main band. As a result, the signal processing time is substantially shortened, compared to that obtained by a division in which the frequency band is finely divided at equal intervals on the frequency vector.

Also, when the frequency bandwidth is made wider for a higher main band, the response to a sharply rising waveform signal improves.

An apparatus and method for compression and expansion of a wave signal on a time axis in accordance with one embodiment of the present invention will be described below with reference to the accompanying drawings.

Figure 3:
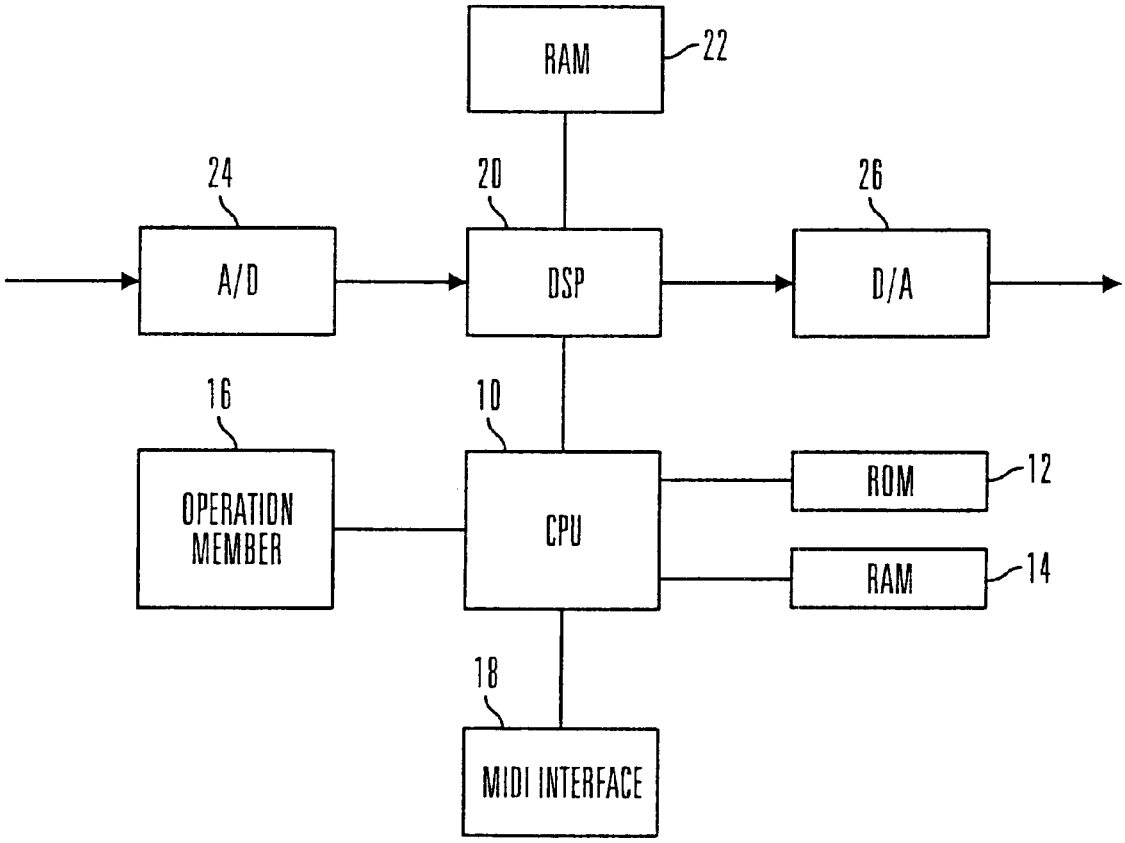
FIG. 3 shows a block diagram of a hardware that realizes an apparatus and method for compression and expansion of a wave signal on a time axis in accordance with one embodiment of the present invention.

FIG. 3 shows a block diagram of a hardware that realizes an apparatus and method for compression and expansion of a wave signal on a time axis (hereafter, referred to as the "apparatus of the present invention" as circumstances warrant) in accordance with one embodiment of the present invention.

The apparatus of the present invention has a central processing unit (CPU) 10 that controls the overall operation of the apparatus of the present invention. The CPU 10 connects, through a bus, to a read only memory (ROM) 12 that stores a program or the like that is executed by the CPU 10, a random access memory 14 that sets a working area for executing the program stored in the ROM 12 by the CPU 10, an operation member 16 that is used to set the number of main bands, i.e., the number of multiple-rate division bands, and the number of sub-bands for each of the main bands, a MIDI interface 18 that provides connections with external MIDI instruments (not shown), and a digital signal processor (DSP) 20 that executes programs such as analysis process, conversion and mixing process and the like that are shown in flow-charts describe below.

The DSP 20 connects to a random access memory (RAM) 22 that sets a working area for executing programs by the DSP 20, an analog/digital converter (A/D) 24 that converts an analog waveform signal into a digital waveform signal and provides the same to the DSP 20, a digital/analog converter (D/A) 26 that converts the digital waveform signal outputted from the DSP 20 into an analog waveform signal and outputs the same.

In the apparatus of the present invention, the DSP 20 processes the waveform signal.

Figure 4:
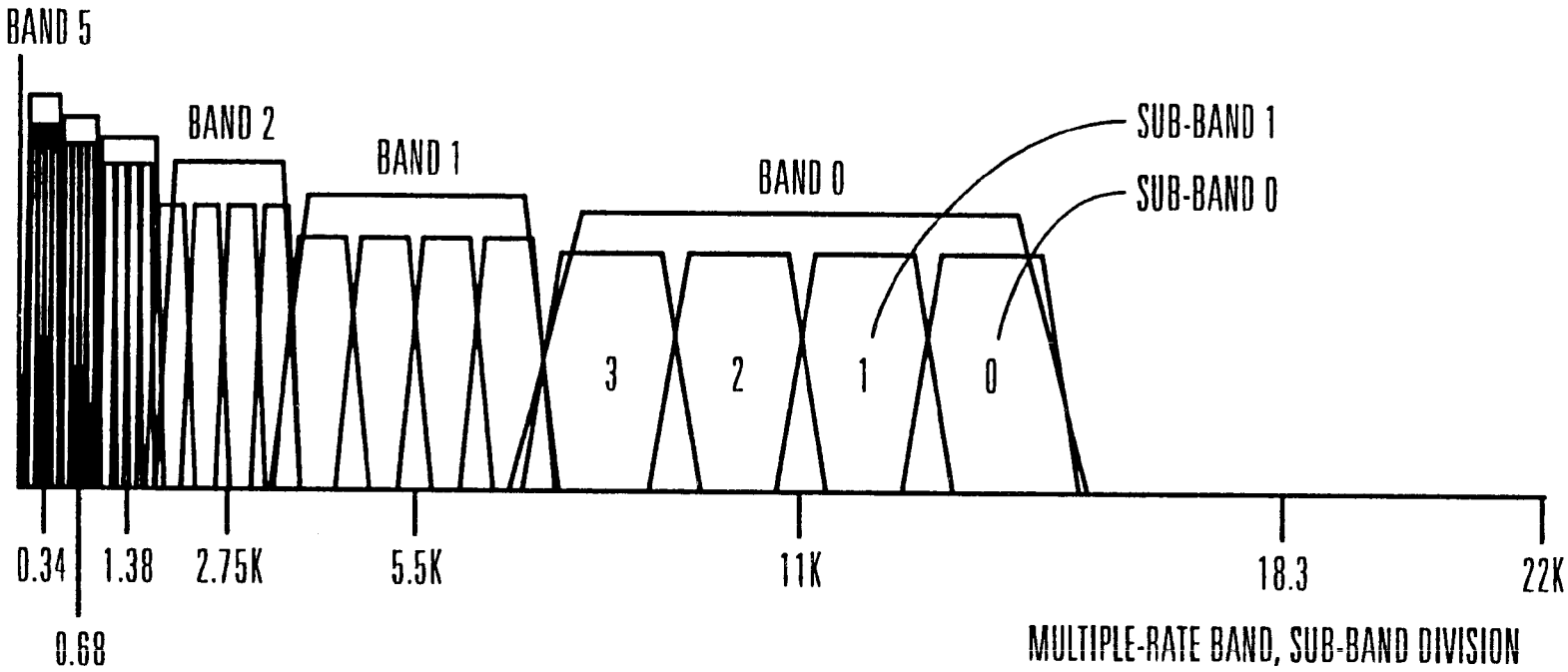
FIG. 4 is a graph showing the relationship between bands (main bands) and sub-bands.

First, a waveform signal is analog-to-digital converted by the analog/digital converter 24. As shown in FIG. 4, the inputted waveform signal is divided into six main bands at sampling rates, starting from the fundamental frequency of 44 KHz, followed by 22 kHz, 11 kHz, 5.5 kHz, 2.75 kHz, 1.38 KHz and 0.68 kHz. Furthermore, each of the main bands is equally divided into four sub-bands.

For the convenience of the description, the depiction of the bands from 14.67 kHz to 22 kHz is omitted from FIG. 4.

In the present embodiment, the uppermost main band is limited to a range from 7.33 kHz to its doubled value, i.e., 14.67 kHz.

Figure 5:
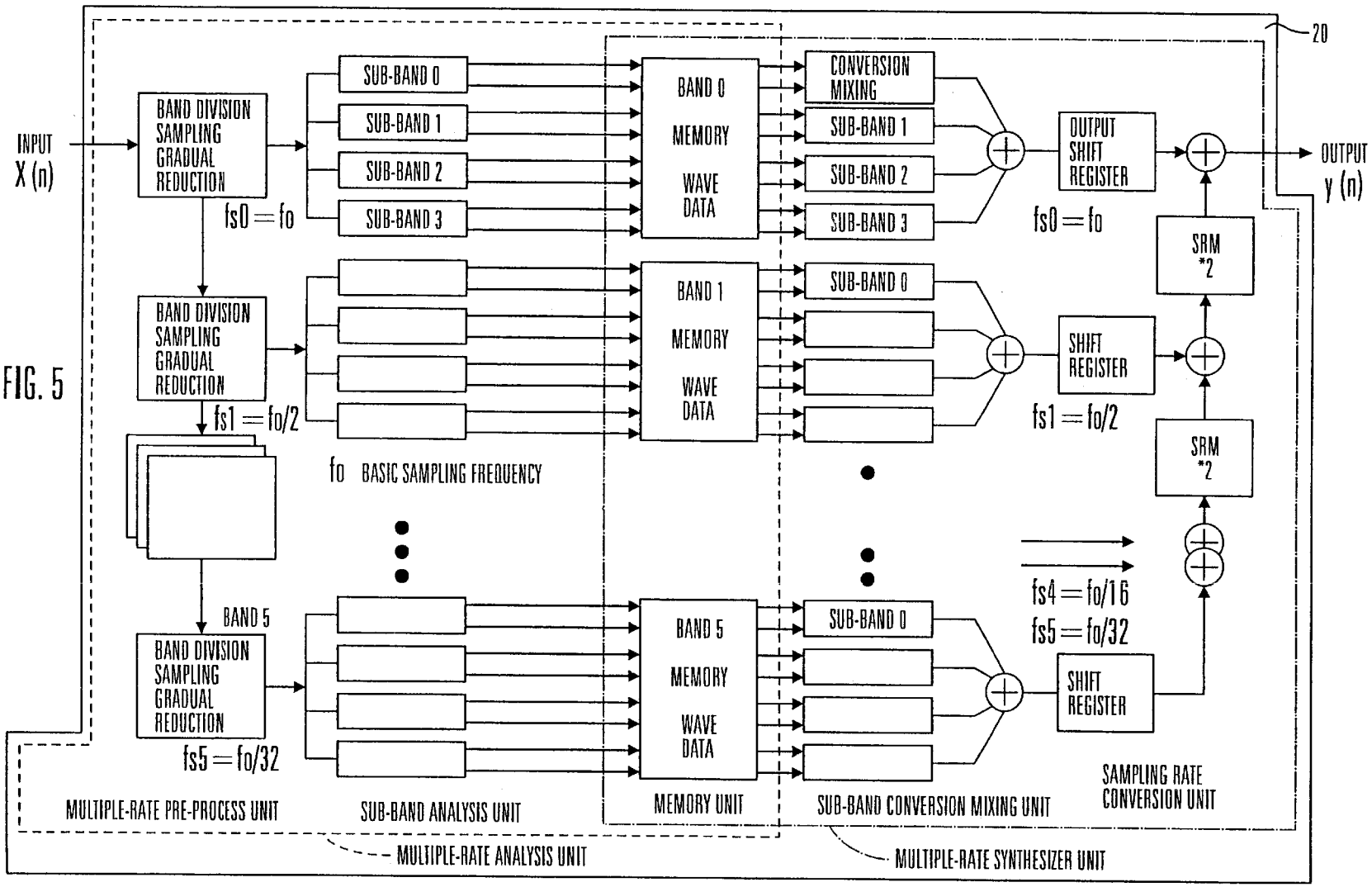
FIG. 5 a block diagram of a circuit that realizes a process for compression and expansion of a wave signal on a time axis with the use of DSP in accordance with one embodiment of the present invention.

FIG. 5 shows a block diagram of a circuit that realizes a process executed by the DSP 20 for compression and expansion of a waveform signal on a time axis. The circuit is composed of a multiple-rate analysis unit and a multiple-rate synthesizer unit.

The multiple-rate analysis unit is formed from a multiple-rate pre-processing unit that divides a waveform signal into main bands and sub-bands, a sub-band analysis unit that analyzes the amplitude value and instantaneous frequency (i.e., the frequency at a particular point on the time axis) of each sub-band, and a memory unit that stores the amplitude value and instantaneous frequency analyzed by the sub-band analysis unit.

The multiple-rate synthesizer unit is formed from a memory unit that stores the amplitude value and instantaneous frequency analyzed by the sub-band analysis unit (in other words, the memory unit is used as a component for both the multiple-rate analysis unit and the multiple-rate synthesizer unit), a sub-band conversion and mixing unit that generates a waveform signal with the amplitude value and the instantaneous frequency, and a sampling rate conversion unit.

Figure 6:
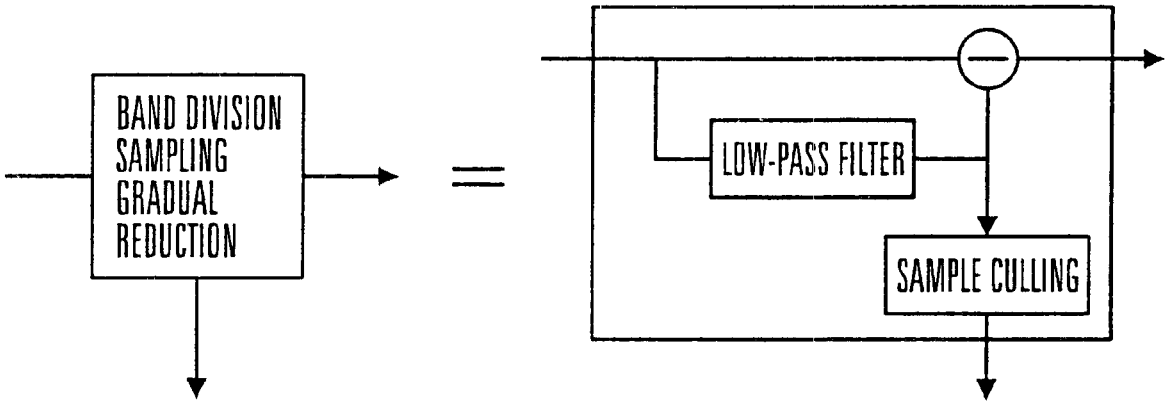
FIG. 6 shows a detailed block diagram of a multiple-rate pre-processing unit.

FIG. 6 shows a detailed block diagram of the multiple-rate pre-processing unit. The multiple-rate pre-processing unit is formed from a low pass filter, a sample culling process circuit, and a subtracter.

Figure 7:
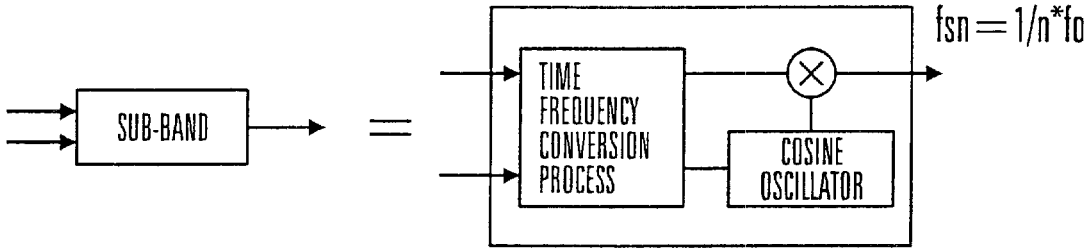
FIG. 7 shows a detailed block diagram of a sub-band conversion and mixing unit.

FIG. 7 shows a detailed block diagram of the sub-band conversion and mixing unit. The sub-band conversion and mixing unit is formed from a time-frequency conversion process circuit and a cosine oscillator and a multiplier.

Figure 8:
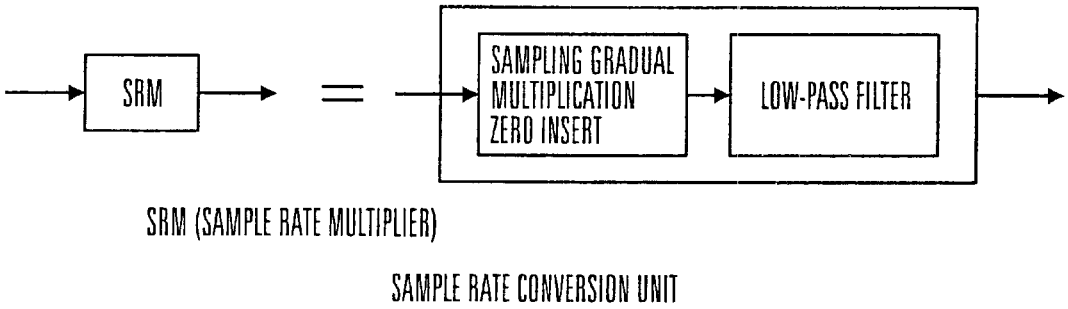
FIG. 8 shows a detailed block diagram of a sampling rate conversion unit.

FIG. 8 shows a detailed block diagram of the sampling rate conversion unit. The sampling rate conversion unit is formed from a sampling gradual multiplication circuit and a low-pass filter.

An analysis process at the multiple-rate conversion unit will be described with reference to the structure describe above. An input signal x (n), i.e., an input waveform signal, is inputted in the multiple-rate pre-processing unit of the multiple-rate analysis unit. The input signal x (n) is passed through the low-pass filter at the multiple-rate pre-processing unit, such that lower band (main band) components are subtracted from the input signal x (n) by the low-pass filter to provide a difference. The difference is defined as a component of band (main-band) 0. The component of band (main-band) 0 is sent to the sub-band analysis unit for band (main-band) 0.

By a similar process, components of the main bands are successively obtained and sent to the sub-band analysis units for the respective main bands.

In the execution of the process for each sub-band, a main-band is divided into four sub-bands, and their amplitudes and instantaneous frequencies are analyzed.

Since the analyzed waveform data (amplitude values and instantaneous frequencies) for the sub-bands are limited in their frequency bands, the sampling period can be substantially reduced, such that the data can be compressed and stored in the memory unit. In the present embodiment, the data can be compressed to the maximum of one sixteenth (1/16) thereof. For the sake of simplification of the description, the description of compression and decompression processes is omitted.

Figure 9:
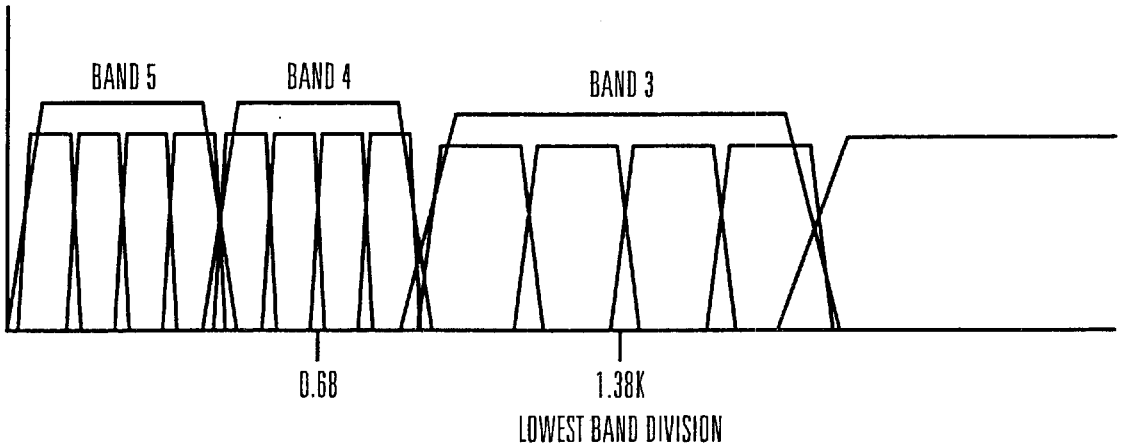
FIG. 9 is a view for illustrating a process for dividing the lowest band (main band) into sub-bands.

The process executed by the multiple-rate pre-processing unit will be described in greater detail. The waveform signal that has passed the low-pass filter is sampled and culled at an interval of one cycle, and sent to the lower bands (main bands). For band (main-band) 1, the same process is executed at one half (½) of the sampling rate that is used for band (main-band) 0. Therefore, analysis data for the four sub-bands can be calculated in half the processing time that is required for the upper band (main band). In a similar manner, the processes are executed up to band (main band) 4. For the lowermost band (main band) 5, the same process as executed for band (main band) 4 may be executed, if the bandwidth of the sub-band 5 is the same as that of the band (main band) 4. This only makes a difference in the center frequency of the analyzed band (main band). Alternatively, referring to FIG. 9, band (main band) 4 and band (main band) 5 may be combined, such that the process is executed for eight sub-bands as the lowermost band (main band).

In the analysis process at the multiple-rate analysis unit described above, the input signal x (n) may be processed in real-time. However, one segment of, or the entire input signal x (n), may be stored in a digital memory; and when the analysis of band (main band) 0 is completed, band (main band) 1 and lower bands (main bands) may be successively analyzed.

Figure 10:
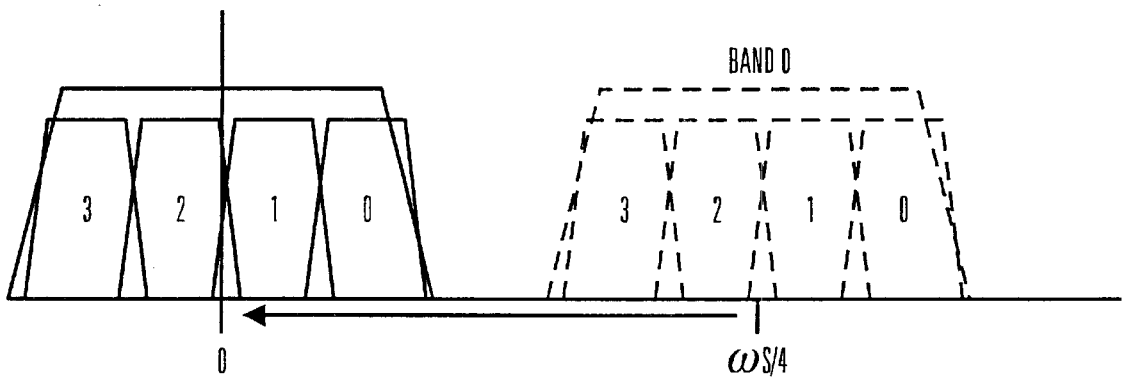
FIG. 10 is a view for illustrating the conversion of band signals into complex numbers.

In accordance with the present embodiment, components of the bands (main bands) are processed at the sampling rates assigned to the respective bands (main bands) to thereby directly analyze the amplitude values and the instantaneous frequencies of the sub-bands. However, as shown in FIG. 10, components of the band may be changed into complex components by multiplying the components of the band by "exp-j (ws/4) n" of a quarter of the sampling rate fs. Further, the components of the band may be divided into sub-bands and analyzed. By this arrangement, the sampling rate can be lowered to one fourth.

When the analysis process at the multiple-rate analyzing unit described above is executed with a digital signal processing program, the multiple-rate pre-process can be commonly used for each of the bands (main bands), and the analysis process of each of the sub-bands in each of the bands (main bands) may be executed with a common process routine.

In the manner described above, the routine for the multiple-rate pre-processing process may be commonly used for each of the bands (main bands). Also, the analysis processes for the sub-bands may be executed with a common process routine. As a result, a digital signal-processing program is shortened and a high speed processing is achieved.

Figure 11:
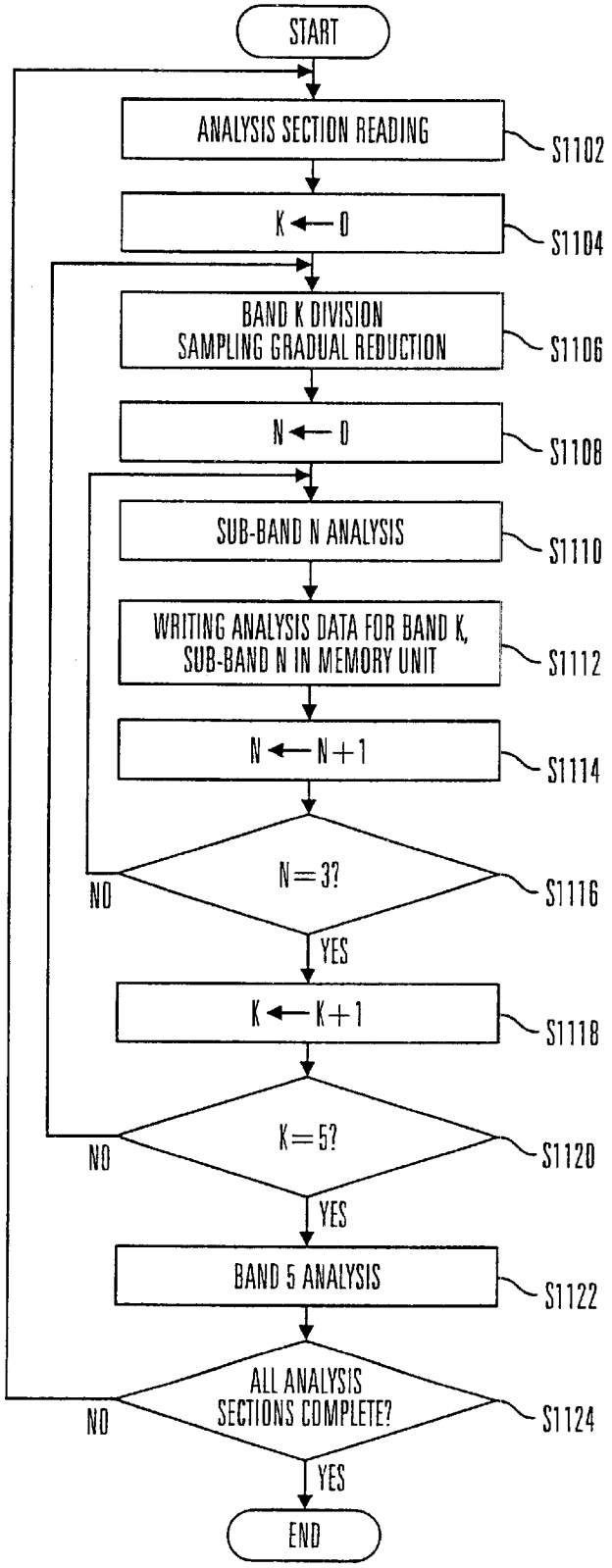
FIG. 11 shows a flow chart of a routine when the conversion and synthesis process by the multiple-rate synthesizer unit is executed by a DSP program.

FIG. 11 shows a flow chart of a routine when the analysis process at the multiple-rate analyzing unit is executed with a program of the DSP20.

In this routine, first, a process for reading an analysis section of the waveform signal is conducted (step S1102). In other words, in order to analyze a specified section of the waveform signal (input signal), the specified section is loaded in the memory of the DSP 20.

Then, a variable K that indicates bands (main band) is set at 0 to select band 0 (step S1104).

Then, processes for band division and sampling gradual-reduction are performed (step S1106). More specifically, the inputted analysis section of the waveform signal is divided by the low-pass filter into a high band region and a low band region. The low band components are sampled with the sampling rate culled by half, and sent to the lower band (main band).

Then, a variable N that indicates a sub-band is set at 0 to select sub-band 0 (step S1108).

Then, the sub-band N is analyzed (step S1110). More specifically, the high band signal, that is divided in step S1106, is further divided into sub-bands N, which are then converted to amplification values and instantaneous frequencies of the waveform signal. As the sampling rate of each of the bands (main bands) is reduced to half, the bandwidth of a low-pass filter for the division is also reduced to half. Therefore, low-pass filters with the same coefficients can be used for all of the bands (main bands) in a similar manner as the one used in this analysis process routine. However, in this case, the amount of sampled data to be analyzed is reduced to half each time the band (main band) number is lowered. In other words, the calculation sampling number is changed by changing the band variable K, such that the sampling in a number corresponding to the sampling rate for a band (main band) is calculated.

Then, the analyzed data for band K and sub-band N in step S1110 are written in a predetermined memory region (step S1112).

Next, the variable N for the sub-band is incremented by one (1), to start the next sub-band process (step S1114).

A determination is made whether or not the variable for the sub-band is 3 (step S1116). When the determination at step S1116 is No (negative); in other words, when the variable N for the sub-band is not 3, and it is determined that the analysis is not completed for all of the sub-bands, the process returns to step S1110, and the analysis of the next sub-band is conducted.

On the other hand, when the determination at step S1116 is Yes (positive); in other words, when the variable N for the sub-band is 3, and it is determined that the analysis is completed for all of the sub-bands, the variable K for the band (main band) is incremented by one (1), and the next band is designated (step S118).

Then, a determination is made whether or not the variable K for the band (main band) is 5 (step S1120). When the result of the determination at step S1120 is negative; in other words, the variable K for the band (main band) is not 5, and therefore it is determined that the band is not the lowest band (main band), the process returns to step S1106, and the division process for the next band (main band) is executed.

On the other hand, when the result of the determination at step S1120 is positive; in other words, the variable K for the band (main band) is 5, and therefore it is determined that the band is the lowest band (main band), an analysis process characteristic to band (main band) 5 is executed (step S1122). Therefore, if the lowest band (main band) has the same bandwidth as that of an upper band (main band), the lowest band can use the same routine as the one used in the upper band (main band). In this case, however, the same sampling rate is used, but the central (analyzed) frequencies of the bands (main bands) are different from one another. In other words, band (main band) 4 and band (main band) 5 are combined, such that the lowest band (main band) having 8 sub-bands is processed.

Next, a determination is made whether or not the entire analysis section is completed (step S1124). If the determination in step S1124 is negative; in other words, when it is determined that the entire analysis section is not completed, the process returns to step S1102, and the process for the next section is executed.

On the other hand, the determination in step S1124 is positive; in other words, it is determined that the entire analysis section is completed, the process for this routine is completed.

Next, the conversion and synthesis process at the multiple-rate synthesizer unit will be described. The amplitude values and the instantaneous frequency data read out from the memory units for the bands (main bands) are time-compressed and expanded and frequency-converted by the sub-band conversion and mixing unit. Then, by using the same principle as the harmonics synthesis, a sine oscillator (sine wave oscillator) for each of the bands (main bands) generates harmonics.

Upon gradually multiplying the sampling rate by the sampling rate conversion unit, the harmonics in each of the bands (main bands) are added to an upper band (main band), and are successively converted to upper sampling rates and mixed. In the present embodiment, since the data of the waveform signal is not culled for compression, the data is encoded directly with the sampling rate used for the band (main bands).

On the other hand, if the data is culled, the data is subject to a time-frequency conversion process with a relatively low sampling rate. Then, the sampling rate can be gradually multiplied in order to synthesize harmonics.

The multiple-rate synthesizer unit has output shift registers. The output shift registers function as buffers for signals between bands (main bands) sampled with different sampling rates and synchronize the signals with one another. For this purpose, the output shift registers temporarily retain data for a predetermined section and output the same.

Figure 12:
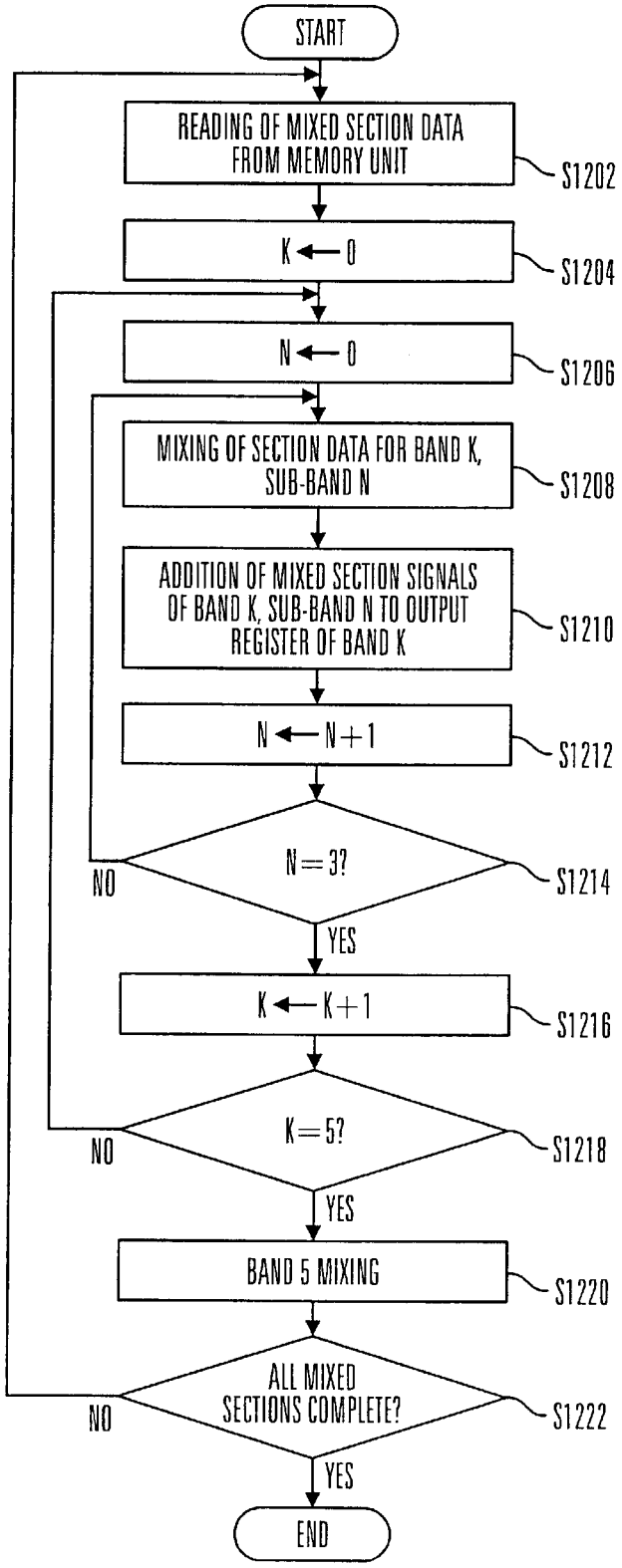
FIG. 12 shows a flow chart of a routine performed when the conversion and synthesis process by the multiple-rate synthesizer unit is executed by a program of the DSP 20.

FIG. 12 shows a flow chart of a routine performed when the conversion and synthesis process by the multiple-rate synthesizer unit is executed by a program of the DSP 20.

In this routine, for synthesis, the analysis data for a specified section of the waveform signal is loaded from the memory unit to a memory of the DSP 20 (step S1202).

Then, the variable K that indicates bands (main bands) is set to 0 to select band 0 (step S1204).

Then, the variable N that indicates sub-bands is set to 0 to select sub-band 0 (step S1206).

Next, based on the analyzed data for the bands (main bands) K and sub-bands N, the waveform signal for the specified section is synthesized (step S1208). In this embodiment, the specified section refers to a section that can be synthesized with the analyzed data read out in step S1202. At each instance in which the band (main band) number lowers, the synthesizing sampling number is reduced to half. However, the reproducing time for the waveform signal is equal in all of the bands. In other words, when the number of bands (main bands) is 6, the sampling number of the highest band (main band) is 32 times greater than that of the lowest band (main band).

In the present embodiment, a basic unit that is 32 times greater than the highest sampling number or its integer multiplier is defined as a synthesis section. In this case, the basic unit is about 0.7 millisecond, which is sufficiently short.

Also, in the conversion synthesis, the same routine may be used for different sampling rates, i.e., different bands (main bands). However, as describe above with respect to the analysis process performed by the multiple-rate analysis unit shown in FIG. 11, at each instance when the sampling rate, i.e., the band (main band) is reduced to half, the data amount to be calculated is reduced to half. In other words, the calculation sampling number is changed by changing the variable K for the bands (main bands), such that the sampling in a number corresponding to the sampling rate for the band is calculated.

Next, the sampled data for the waveform signal for the specified section is added to the output register for the band (main band) K (step S1210). The output register retains series of mixed signals previously mixed. The output register is a shift register, and shifts and outputs data at the sampling rate for the band (main band) K. When the mixed signals for all of the sub-bands are added, they are added to the mixed signals that are provided from the lower band (main band), and then sent to the sample rate conversion unit.

Then, the variable K for the sub-bands is incremented by one (1), and the process proceeds to the next sub-band process (step S1212).

A determination is made whether or not the variable for the sub-band is 3 (step S1214). When the determination at step S1214 is negative; in other words, when the variable N for the sub-band is not 3, and it is determined that the analysis is not completed for all of the sub-bands, the process returns to step S1208, and the analysis of the next sub-band is conducted.

On the other hand, when the determination at step S1214 is positive; in other words, when the variable N for the sub-band is 3, and it is determined that the analysis is completed for all of the sub-bands, the variable K for the band (main band) is incremented by one (1), and the next band is designated (step S1216).

Then, a determination is made whether or not the variable K for the band (main band) is 5 (step S1218). When the result of the determination at step S1218 is negative; in other words, the variable K for the band (main band) is not 5, and therefore it is determined that the band is not the lowest band (main band), the process returns to step S1206, and the division process for the next band (main band) is executed.

On the other hand, when the result of the determination at step S1218 is positive; in other words, the variable K for the band (main band) is 5, and therefore it is determined that the band is the lowest band (main band), an analysis process characteristic to band (main band) 5 is executed (step S1220). Therefore, since the lowest band (main band) has the same bandwidth as that of a next upper band (main band), the lowest band can use the same routine as the one used in the upper band (main band). However, in this case, the same sampling rate is used, but the central (synthesis) frequencies of the bands (main bands) are different from one another.

Next, a determination is made whether or not the entire synthesis section is completed (step S1222). If the determination in step S1222 is negative; in other words, when it is determined that the entire synthesis section is not completed, the process returns to step S1202, and the process for the next section is executed.

On the other hand, the determination in step S1222 is positive; in other words, it is determined that the entire synthesis section is completed, the process for this routine is completed.

In the embodiments described above, the present invention is applied to the compression and expansion of a waveform signal on a time axis, namely, to the time stretching. However, the present invention is not limited to these embodiments. The present invention is also applicable to the musical note generation process in which the pitch and time are changed by instructions through the keyboard based on analysis parameters and analyzed waveform data for each band (main band) and notes are instantaneously generated.

What is claimed is:

1. An apparatus for compression and expansion of a wave signal on a time axis, the apparatus comprising:

a memory device that stores waveform data representative of a waveform for each sub-frequency band of each main-frequency band of a wave signal, in which the wave signal is divided into a plurality of the main-frequency bands, each of the main-frequency bands is divided into a plurality of the sub-frequency bands;

a plurality of time axis compression and expansion devices, each provided for each of the sub-frequency bands for performing, based on the waveform data for each of the sub-frequency bands, a time axis compression and expansion of the waveform that is represented by the waveform data; and a mixing device that mixes signals provided from the plurality of time axis compression and expansion devices, wherein each of the plurality of time axis compression and expansion devices performs compression and expansion at a sampling rate that corresponds to one of the main-frequency bands to which the sub-frequency band that is subject to the waveform time axis compression and expansion belongs, and wherein a sampling rate of at least one of the main-frequency bands is different from a sampling rate of at least one other of the main-frequency bands.

2. The apparatus for compression and expansion of a wave signal on a time axis as recited in claim 1, wherein each of the main-frequency bands have the same number of sub-frequency bands.

3. The apparatus for compression and expansion of a wave signal on a time axis as recited in claim 2, wherein the time axis compression and expansion devices for the waveform signal are implemented by software, and a program sub-routine for a time axis compression and expansion process in one main-frequency band is commonly used for a time axis compression and expansion process in another main-frequency band.

4. The apparatus for compression and expansion of a wave signal on a time axis as recited in claim 2, wherein the time axis compression and expansion devices for the waveform signal are implemented by software, and the time axis compression and expansion devices for the sub-frequency bands that belong to the same main-frequency band use the same process program routine.

5. The apparatus for compression and expansion of a wave signal on a time axis as recited in claim 1, wherein the plurality of time axis compression and expansion devices compress the wave signal such that a time period on the time axis for reproducing the wave signal in an audible form is reduced.

6. The apparatus for compression and expansion of a wave signal on a time axis as recited in claim 1, wherein the plurality of time axis compression and expansion devices expand the wave signal such that a time period on the time axis for reproducing the wave signal in an audible form is increased.

7. An apparatus for compression and expansion of a wave signal on a time axis, the apparatus comprising:

a memory device that stores waveform data representative of a waveform for each sub-frequency band of each main-frequency band of a wave signal, in which the wave signal is divided into a plurality of the main-frequency bands, a waveform signal of each of the main-frequency bands is divided into a plurality of the sub-frequency bands;

a plurality of time axis compression and expansion devices, each provided for each of the sub-frequency bands for performing, based on the waveform data for each of the sub-frequency bands, time axis compression and expansion of the waveform that is represented by the waveform data; and a mixing device that mixes signals provided from the plurality of time axis compression and expansion devices, wherein the time axis compression and expansion devices for the sub-frequency bands that belong to the same main-frequency band perform compression and expansion at the same sampling rate, and wherein the time axis compression and expansion devices for the sub-frequency bands that belong to one of the main-frequency bands perform compression and expansion at a sampling rate that is different from a sampling rate for the sub-frequency bands that belong to another of the main-frequency bands.

8. The apparatus for compression and expansion of a wave signal on a time axis as recited in claim 7, wherein the plurality of time axis compression and expansion devices compress the wave signal such that a time period on the time axis for reproducing the wave signal in an audible form is reduced.

9. The apparatus for compression and expansion of a wave signal on a time axis as recited in claim 7, wherein the plurality of time axis compression and expansion devices expand the wave signal such that a time period on the time axis for reproducing the wave signal in an audible form on the time axis is increased.

10. The apparatus for compression and expansion of a wave signal on a time axis as recited in claim 7, wherein a frequency bandwidth of a higher main-frequency band is wider than that of a lower main-frequency band.

11. The apparatus for compression and expansion of a wave signal on a time axis as recited in claim 7, wherein each of the main-frequency bands have the same number of sub-frequency bands.

12. The apparatus for compression and expansion of a wave signal on a time axis as recited in claim 11, wherein the time axis compression and expansion devices for the waveform signal are implemented by software, and a program sub-routine for a time axis compression and expansion process in one main-frequency band is commonly used for a time axis compression and expansion process in another main-frequency band.

13. The apparatus for compression and expansion of a wave signal on a time axis as recited in claim 11, wherein the time axis compression and expansion devices for the waveform signal are implemented by software, and the time axis compression and expansion devices for the sub-frequency bands that belong to the same main-frequency band use the same process program routine.

14. An apparatus for compression and expansion of a wave signal on a time axis, the apparatus comprising:

a memory device that stores waveform data representative of a waveform for each sub-frequency band of each main-frequency band of a wave signal, in which the wave signal is divided into a plurality of the main-frequency bands, at least one of the main-frequency bands having a bandwidth different from at least one other of the main-frequency bands, each of the main-frequency bands being divided into a plurality of the sub-frequency bands;

a plurality of time axis compression and expansion devices, each provided for each of the sub-frequency bands for performing, based on the waveform data for each of the sub-frequency bands, a time axis compression and expansion of the waveform that is represented by the waveform data; and a mixing device that mixes signals provided from the plurality of time axis compression and expansion devices, wherein each of the plurality of time axis compression and expansion devices performs compression and expansion at a sampling rate that corresponds to one of the main-frequency bands to which the sub-frequency band that is subject to the waveform time axis compression and expansion belongs, and wherein a sampling rate of at least one of the main-frequency bands is different from a sampling rate of at least one other of the main-frequency bands.

15. A method for compression and expansion of a wave signal on a time axis, the method comprising:

dividing a wave signal into a plurality of main-frequency bands;

dividing each of the main-frequency bands into a plurality of sub-frequency bands;

performing, based on waveform data for each of the sub-frequency bands, a time axis compression and expansion of the waveform that is represented by the waveform data at a sampling rate that corresponds to one of the main-frequency bands to which the sub-frequency band that is subject to the waveform time axis compression and expansion belongs, wherein a sampling rate of at least one of the main-frequency bands is different from a sampling rate of at least one other of the main-frequency bands; and mixing signals resulting from the time axis compression and expansion of the waveform.

16. The method for compression and expansion of a wave signal on a time axis as recited in claim 15, wherein each of the main-frequency bands is divided into the same number of sub-frequency bands.

17. The method for compression and expansion of a wave signal on a time axis as recited in claim 16, wherein performing the time axis compression and expansion of the waveform comprises implementing a software program, wherein a program sub-routine for a time axis compression and expansion process in one main-frequency band is commonly used for a time axis compression and expansion process in another main-frequency band.

18. The method for compression and expansion of a wave signal on a time axis as recited in claim 16, wherein performing the time axis compression and expansion of the waveform comprises implementing a software program, and wherein the sub-frequency bands that belong to one main-frequency band use the same program routine.

19. The method for compression and expansion of a wave signal on a time axis as recited in claim 15, wherein the wave signal is divided into a plurality of main-frequency bands having different bandwidths.

20. The method for compression and expansion of a wave signal on a time axis as recited in claim 19, wherein the wave signal is divided such that a frequency bandwidth of a higher main-frequency band is wider than that of a lower main-frequency band.

21. A method for compression and expansion of a wave signal on a time axis, the method comprising:

dividing a wave signal into a plurality of main-frequency bands;

dividing each of the main-frequency bands into a plurality of the sub-frequency bands;

performing, based on waveform data for each of the sub-frequency bands, a time axis compression and expansion of the waveform that is represented by the waveform data, the time axis compression and expansion being performed at a first sampling rate for sub-frequency bands that belong to one of the main-frequency bands and in at least a second sampling rate for sub-frequency bands that belong to others of the main-frequency bands; and mixing signals resulting from the time axis compression and expansion of the waveform.

22. The method for compression and expansion of a wave signal on a time axis as recited in claim 21, wherein each of the main-frequency bands is divided into the same number of sub-frequency bands.

23. The method for compression and expansion of a wave signal on a time axis as recited in claim 22, wherein performing the time axis compression and expansion of the waveform comprises implementing a software program, wherein a program sub-routine for a time axis compression and expansion process in one main-frequency band is commonly used for a time axis compression and expansion process in another main-frequency band.

24. The method for compression and expansion of a wave signal on a time axis as recited in claim 22, wherein performing the time axis compression and expansion of the waveform comprises implementing a software program, and wherein the sub-frequency bands that belong to one main-frequency band use the same program routine.

25. The method for compression and expansion of a wave signal on a time axis as recited in claim 21, wherein each of the main-frequency bands is divided into four sub-frequency bands.

* * * * *